United States Patent [19]

Dolhyj et al.

[11] 4,407,661

[45] Oct. 4, 1983

[54] MOTOR FUEL ADDITIVES DERIVED FROM SHALE OIL

[75] Inventors: Serge R. Dolhyj, Parma; Christos Paparizos, Willowick, both of Ohio

[73] Assignee: Standard Oil Company, Cleveland, Ohio

[21] Appl. No.: 327,831

[22] Filed: Dec. 7, 1981

[51] Int. Cl.[3] ..... C10L 1/18

[52] U.S. Cl. ..... 44/78

[58] Field of Search ..... 44/78; 568/630, 658

[56] References Cited

U.S. PATENT DOCUMENTS

| | | | |
|---|---|---|---|
| 2,009,118 | 7/1935 | Morrell | 44/9 |
| 2,046,243 | 6/1936 | Buc | 44/9 |
| 2,103,736 | 12/1938 | Skraup | 568/658 |
| 2,248,518 | 7/1941 | Stanley et al. | 568/626 |
| 2,445,500 | 7/1948 | Tyrer | 568/630 |
| 2,487,832 | 11/1949 | Searle | 568/630 |
| 2,529,887 | 11/1950 | Smutz | 568/630 |
| 2,699,385 | 1/1955 | Stevens et al. | 52/0.5 |
| 2,777,000 | 1/1957 | Shaw | 568/626 |
| 2,891,851 | 6/1959 | Bailey et al. | 44/78 |
| 3,476,814 | 11/1969 | Mettsner | 44/77 |
| 3,594,136 | 7/1971 | Rosen | 44/51 |
| 3,717,611 | 2/1973 | Baumer et al. | 260/45.95 G |
| 3,836,342 | 9/1974 | Shang et al. | 252/386 |
| 3,976,437 | 8/1976 | Shang et al. | 44/56 |
| 4,236,030 | 11/1980 | Selwitz et al. | 568/756 |
| 4,244,704 | 1/1981 | Sweeney et al. | 44/78 |

FOREIGN PATENT DOCUMENTS 9966 4/1980 European Pat. Off. .

OTHER PUBLICATIONS

Wartime Report ARR-E6B14, (Mar. 1946), Jones et al.

"The Effects of Tetraethyl Lead on Flame Propagation & Cyclic Dispersion Spark-Ignition Engines", Ellison et al., J. Inst. of Petro,. vol. 54, #537, (9/68).

"Are There Substitutes for Lead Antiknocks", Unzelman et al., Proc. Delv. Refining, Amer. Petro. Inst., 1971.

Barnett, "Summary of NACA Research on Antiknock Characteristics of Hydrocarbons and Ethers", Proc. 3rd World Petroleum Congress, Hague, 1951, Sect. IV, pp. 397-419.

*Primary Examiner*—Anton H. Sutto

*Assistant Examiner*—Y. Harris-Smith

*Attorney, Agent, or Firm*—Gary R. Plotecher; Herbert D. Knudsen; Larry W. Evans

[57] ABSTRACT

The octane number of unleaded gasoline is improved by the addition of a mixture of etherified phenols obtained from crude shale oil.

5 Claims, No Drawings

MOTOR FUEL ADDITIVES DERIVED FROM SHALE OIL

BACKGROUND OF THE INVENTION

1. Field of the Invention

This invention relates to motor fuel. In one aspect, the invention relates to the use of a mixture of etherified phenols as octane improvers for motor fuel while in another aspect, the invention relates to manufacturing the mixture from shale oil.

2. Description of the Art

For years the petroleum industry relied upon the additive tetraethyllead and other alkyl lead compounds as a means for imparting high anti-knock qualities to gasoline. However, due to environment considerations these additives are being continually deemphasized and the industry has been continually searching for alternatives. Many such alternatives have been developed with the alcohols and ethers, such as methanol and methyl t-butyl ether, being representative. These materials have been found to increase the octane number of gasoline and have gained a fair degree of acceptance to one degree or another. However, the present costs and availability of these additives provide impetus to continue the search for new additives.

U.S. Pat. No. 3,836,342 to Shang et al. teaches the use of phenolic alkyl ethers in combination with substituted phenols as a gasoline additive to improve octane number. Wartime Report ARR-E6B14 by the National Advisory Committee for Aeronautics discloses that anisole and other ethers are useful octane improvers for gasoline.

SUMMARY OF THE INVENTION

According to this invention, a mixture of ethers useful for improving the octane number of gasoline is prepared by:

A. Separating a phenolic fraction from crude shale oil,

B. Etherifying the phenolic fraction with a lower alkyl alcohol, and

C. Blending the etherified mixture of B with a motor fuel.

This invention provides a large source of inexpensive octane improvers for motor fuel and the etherified mixture compares favorably with methyl t-butyl ether as an octane improver.

DETAILED DESCRIPTION OF THE INVENTION

Shale oil from any source can be used as the source of the phenolic fraction. Typically the shale oil here used is crude shale oil recovered from a retort and containing between about 0.1 wt % and 10 wt % phenolic materials. By the terms "phenolics", "phenolic materials", "phenols" and the like is meant not only phenol itself but also those compounds containing a hydroxyl group attached to a single aromatic nucleus, as well as homologs of these compounds with one or more alkyl radicals directly attached to the aromatic nucleus, such as phenol, o-, m- and p-cresols, o-, m- and p-ethylphenols, 2,3-, 2,4-, 2,5-, 3,4- and 3,5-xylenols, etc.

The phenolics are readily removed or separated from the crude shale oil by contacting it with any suitable material capable of removing at least a portion of the phenolic fraction from the shale oil bulk. These materials include the various alkali metal hydroxides, basic ion-exchange resins, ammonia, etc. but for reasons of convenience and economy, alkali metal hydroxides, particularly sodium and potassium hydroxide, are preferred extracting agents. The concentration of the hydroxide in the aqueous medium can vary widely but typically the concentration is at least about 0.1 wt % and preferably at least about 1 wt %. Extraction can and typically is carried out at room temperature and atmospheric pressure although other temperatures and pressures can be used.

The composition of the phenolic fraction will vary with the extraction technique and shale oil source. Typically, the fraction will contain significant amounts of phenol and the various isomers of cresol, ethyl phenol, xylenol and the various $C_3$ alkyl phenols. The weight percent of the individual components of the phenolic fraction will also vary widely but generally the phenol portion of the fraction is less than about 20 wt % and for use in this invention, preferably less than about 15 wt %.

If the phenolic fraction has been extracted from the crude shale oil with an alkali metal hydroxide, then after the fraction has been physically separated from the crude shale oil bulk the pH of the fraction is adjusted to a number less than about 9. Any strong acid, e.g. sulfuric acid, can be used to make this adjustment. At this pH, typically about 8–8.5, the phenolic fraction phase separates into a first phase of phenols and a second phase of nonphenolic materials, typically the salts of various carboxylic acids. These two phases are then physically separated, and the phenols are then mixed with one or more lower ($C_1$–$C_4$) alkyl alcohols, such as methanol, in the presence of a strong acid and subjected to etherification conditions, such as slightly elevated temperature and atmospheric pressure, to produce an etherified mixture of phenols. Any known etherification process can be here used although strong acid catalysts is preferred, again for reasons of convenience and economy.

Although the amounts of the various ethers in the final mixture will track the amounts of the corresponding phenolics in the extracted fraction, these amounts can differ depending on additions and/or substractions made to the final mixture. However, some components are generally present within certain ranges and in one embodiment, the following ethers are present within the stated ranges:

| Component | Wt % Based on Total Weight of Final Mixture | |
|---|---|---|
| | Broad | Preferred |
| Anisole | 3–20 | 5–15 |
| o-Methylanisole | 3–25 | 5–20 |
| m-Methylanisole | 1–15 | 3–10 |
| p-Methylanisole | 3–20 | 5–15 |
| 2,6-Dimethylanisole | 1–10 | 2–8 |
| 2,4-Dimethylanisole | 3–25 | 5–20 |
| 2,5-Dimethylanisole | 3–25 | 5–20 |
| 2,3-Dimethylanisole | 5–30 | 10–25 |
| 3,5-Dimethylanisole | 5–30 | 10–25 |
| 3,4-Dimethylanisole | 1–15 | 3–10 |

Other etherified phenols can be present, such as etherified $C_3$ alkyl phenols, ethyl phenols, $C_4$–$C_6$ phenols, etc., as well as relatively minor amounts (typically less than 1 wt %) of nonphenolic impurities usually found in the phenolic fraction of shale oil, such as carboxylic acids.

The etherified phenolic mixture is then blended with motor fuel in the same manner motor fuel is blended with other octane improvers. The motor fuel comprises gasoline but may contain other octane improvers. Although the etherified mixture can be blended with gasoline in any desired proportion, preferably the etherified mixture comprises between about 1 and about 20 wt % of the final motor fuel composition. While the etherified mixture is considered a substitute for methyl t-butyl ether, the etherified mixture can be used in combination with it.

The following examples are illustrative of certain specific embodiments of this invention. Unless indicated otherwise, all parts and percentages are by weight.

SPECIFIC EMBODIMENTS

Analysis of a the Phenolic Fraction of a Crude Shale Oil

A sample of a Paraho shale qil fraction with a boiling range of 177°–288° C. was extracted with a 10% sodium hydroxide solution. The free phenols were obtained by a controlled reduction of the pH to about 8.5 by the addition of sulfuric acid. After separation from the non-phenolic fraction, the phenolic fraction was then subjected to hydrogen NMR spectroscopy and found to contain the following components:

TABLE

PHENOLS FROM SHALE OIL FRACTION (10 percent NaOH extract)

| Constituent | % wt |
|---|---|
| Phenol | 7.3 |
| o-Cresol | 8.4 |
| m-Cresol | 5.0 |
| p-Cresol | 7.1 |
| Ethyl phenol I | 2.0 |
| Ethyl phenol II | 1.0 |
| Ethyl phenol III | 3.7 |
| 2,6-Xylenol | 3.5 |
| 2,4 and 2,5-Xylenol | 9.1 |
| 2,3 and 3,5-Xylenol | 13.1 |
| 3,4-Xylenol | 4.7 |
| $C_3$ Alkyl phenol I | 5.8 |
| $C_3$ Alkyl phenol II | 1.6 |
| $C_3$ Alkyl phenol III | 1.6 |
| $C_3$ Alkyl phenol IV | 3.7 |
| 2,4,6-Trimethyl phenol | 2.0 |
| 2,4,5-Trimethyl phenol | 9.9 |
| 2,3,4-Trimethyl phenol | 2.2 |
| 3,4,5-Trimethyl phenol | 1.3 |
| $C_3/C_4$ Alkyl phenol | 4.2 |
| $C_3/C_4$ phenol | 2.0 |
| $C_4$ Alkyl phenol | 0.9 |

The Roman Numerals following the ethyl phenols and $C_3$ alkyl phenols designate different isomers, the exact identity of each isomer not known.

Preparation of a Synthetic Shale Oil Phenolic Fraction

Based on the results shown in Table I, a synthetic mixture of phenolic ethers was prepared having the following composition:

TABLE II

| Ether | Wt % |
|---|---|
| Anisole | 12.5 |
| o-methylanisole | 14.4 |
| m-methylanisole | 8.6 |
| p-methylanisole | 12.2 |
| 2,6-dimethylanisole | 6.0 |
| 2,4-dimethylanisole | 15.6 |
| 2,5-dimethylanisole | 15.6 |
| 2,3-dimethylanisole | 22.5 |
| 3,5-dimethylanisole | 22.5 |

TABLE II-continued

| Ether | Wt % |
|---|---|
| 3,4-dimethylanisole | 8.1 |

The phenolic counter parts to the components in the above Table constituted 58.2 wt % of the phenolic mixture characterized in Table I. Accordingly, the respective amounts of the individual components in the above Table were calculated by standarizing the 58.2 wt % to 100 wt %, e.g. The amount of anisole in the synthetic mixture was determined by dividing the product of 7.3 wt % × 100 by 58.2 wt %.

Anti-Knock Testing

The anti-knock quality of gasoline is rated by two laboratory knock-test procedures, both of which employ the cooperative fuel research (CFR) knock test engine. THe CFR engine is a single cylinder 4-stroke engine in which the compression can be varied at will. This engine has been adopted as a standard for determining octane number. To determine the anti-knock quality of a fuel, the CFR engine is operated on the fuel under a standard set of conditions and the compression ratio is adjusted to give a standard level of knock intensity. This knock level is then bracketed by two blends of the reference fuels, one of which knocks a little more than the test fuels, the other of which knocks a little less. The knock rating of the fuel being rated is determined by interpolation between the knock meter readings of the reference fuels to find a reference fuel composition that just matches the knock meter reading of the test sample.

The two laboratory knock-test procedures are the motor method (ASTMD-2623) and the research method (ASTMD-2699). The research method was adopted as a testing procedure when it became apparent that newer refinery processes and engine improvements gave gasoline much better road performance then their motor method ratings would indicate. Both methods continue in use however because together they predict the road performance of a gasoline better than either does alone. If two fuels have the same motor method octane number, the one with the greater research method ratings will usually satisfy a greater percentage of the cars on the road. The difference between the research ratings of a gasoline and its motor rating is called sensitivity. This difference indicates how sensitive a gasoline is in terms of anti-knock performance to more severe engine operating conditions. Among fuels of equal octane number, the fuel having the least sensitivity generally will give the best road anti-knock performance.

EXAMPLE 1

A 10% by volume blend of the synthetic mixture described in Table II and unleaded gasoline was prepared. The octane number of this blend was determined by both the research and motor methods. The results are shown in Table III.

EXAMPLE 2

A 10% by volume blend of methyl t-butyl ether and unleaded gasoline was prepared. The octane number of this blend was also determined by the procedures outlined in example 1. The results are also known in table III.

TABLE III

| Example | Octane Number Motor Method | Octane Number Research Method | Sensitivity (RM-MM) |
|---|---|---|---|
| 1 | 84.0 | 94.2 | 10.2 |
| | 83.4 | 91.8 | 8.4 |
| 2 | 85.0 | 94.2 | 9.2 |
| | 83.8 | 91.8 | 8.0 |

As the data in the above Table indicates, the synthetic mixture of Table Ii performs essentially the same as the widely accepted anti-knock additive, methyl t-butyl ether. Yet the anti-knock composition of example 1 is potentially available in large quantities and at relatively little expense.

Although the invention has been described by the preceding examples in a relatively detailed manner, these examples are provided for illustration purposes only and are not to be construed as limitations upon the scope and spirit of the appended claims.

What is claimed is:

1. A motor fuel comprising a blend of:

A. A mixture of hydrocarbons boiling within the gasoline range, and

B. An etherified mixture of phenols, the phenols obtained from retorted shale oil.

2. The motor fuel composition of claim 1 where the etherified mixture of phenols contains anisole, o-, m- and p-methylanisole and the various isomers of dimethylanisole.

3. The motor fuel composition of claim 2 where the etherified mixture of phenols contains:

| Component | Wt % Based on Total Weight of the Etherified Mixture |
|---|---|
| Anisole | 3–20 |
| o-Methylanisole | 3–25 |
| m-Methylanisole | 1–15 |
| p-Methylanisole | 3–20 |
| 2,6-Dimethylanisole | 1–10 |
| 2,4-Dimethylanisole | 3–25 |
| 2,5-Dimethylanisole | 3–25 |
| 2,3-Dimethylanisole | 5–30 |
| 3,5-Dimethylanisole | 5–30 |
| 3,4-Dimethylanisole | 1–15 |

4. The motor fuel composition of claim 2 where the etherified mixture of phenols contains:

| Component | Wt % Based on Total Weight of the Etherified Mixture |
|---|---|
| Anisole | 5–15 |
| o-Methylanisole | 5–20 |
| m-Methylanisole | 3–10 |
| p-Methylanisole | 5–15 |
| 2,6-Dimethylanisole | 2–8 |
| 2,4-Dimethylanisole | 5–20 |
| 2,5-Dimethylanisole | 5–20 |
| 2,3-Dimethylanisole | 10–25 |
| 3,5-Dimethylanisole | 10–25 |
| 3,4-Dimethylanisole | 3–10 |

5. The motor fuel composition of claim 4 where the etherified mixture comprises between about 1 and about 20 wt % of the total motor fuel composition.

* * * * *